US009142205B2

(12) United States Patent
Alderson et al.

(10) Patent No.: US 9,142,205 B2
(45) Date of Patent: Sep. 22, 2015

(54) LEAKAGE-MODELING ADAPTIVE NOISE CANCELING FOR EARSPEAKERS

(71) Applicant: Cirrus Logic, Inc., Austin, TX (US)

(72) Inventors: Jeffrey Alderson, Austin, TX (US); Jon D. Hendrix, Wimberly, TX (US)

(73) Assignee: Cirrus Logic, Inc., Austin, TX (US)

( * ) Notice: Subject to any disclaimer, the term of this patent is extended or adjusted under 35 U.S.C. 154(b) by 373 days.

(21) Appl. No.: 13/692,367

(22) Filed: Dec. 3, 2012

(65) Prior Publication Data

US 2013/0287218 A1 Oct. 31, 2013

Related U.S. Application Data

(60) Provisional application No. 61/638,602, filed on Apr. 26, 2012.

(51) Int. Cl.
*G10K 11/00* (2006.01)
*G10K 11/178* (2006.01)

(52) U.S. Cl.
CPC ..... *G10K 11/002* (2013.01); *G10K 11/1788* (2013.01); *G10K 2210/1081* (2013.01); *G10K 2210/505* (2013.01); *G10K 2210/506* (2013.01)

(58) Field of Classification Search
None
See application file for complete search history.

(56) References Cited

U.S. PATENT DOCUMENTS 5,251,263 A 10/1993 Andrea et al.
5,278,913 A 1/1994 Delfosse et al.
5,321,759 A 6/1994 Yuan
5,337,365 A 8/1994 Hamabe et al.
5,359,662 A 10/1994 Yuan et al.
5,410,605 A 4/1995 Sawada et al.
5,425,105 A 6/1995 Lo et al.
5,445,517 A 8/1995 Kondou et al.
5,465,413 A 11/1995 Enge et al.
5,548,681 A 8/1996 Gleaves et al.

(Continued)

FOREIGN PATENT DOCUMENTS

DE 102011013343 A1 9/2012
EP 1880699 A2 1/2008

(Continued)

OTHER PUBLICATIONS

U.S. Appl. No. 14/228,322, filed Mar. 28, 2014, Alderson, et al.

(Continued)

*Primary Examiner* — Thang Tran
(74) *Attorney, Agent, or Firm* — Mitch Harris, Atty at Law, LLC; Andrew M. Harris

(57) ABSTRACT

A personal audio device, such as a headphone, includes an adaptive noise canceling (ANC) circuit that adaptively generates an anti-noise signal from a reference microphone signal that measures the ambient audio, and the anti-noise signal is combined with source audio to provide an output for a speaker. The anti-noise signal causes cancellation of ambient audio sounds that appear at the reference microphone. A processing circuit uses the reference microphone to generate the anti-noise signal, which can be generated by an adaptive filter. The processing circuit also models an acoustic leakage path from the transducer to the reference microphone and removes elements of the source audio appearing at the reference microphone signal due to the acoustic output of the speaker. Another adaptive filter can be used to model the acoustic leakage path.

30 Claims, 4 Drawing Sheets

(56) References Cited

U.S. PATENT DOCUMENTS 5,586,190 A 12/1996 Trantow et al.
5,640,450 A 6/1997 Watanabe
5,699,437 A 12/1997 Finn
5,706,344 A 1/1998 Finn
5,740,256 A 4/1998 Castello Da Costa et al.
5,768,124 A 6/1998 Stothers et al.
5,815,582 A 9/1998 Claybaugh et al.
5,832,095 A 11/1998 Daniels
5,946,391 A 8/1999 Dragwidge et al.
5,991,418 A 11/1999 Kuo
6,041,126 A 3/2000 Terai et al.
6,118,878 A 9/2000 Jones
6,219,427 B1 4/2001 Kates et al.
6,278,786 B1 8/2001 McIntosh
6,282,176 B1 8/2001 Hemkumar
6,418,228 B1 7/2002 Terai et al.
6,434,246 B1 8/2002 Kates et al.
6,434,247 B1 8/2002 Kates et al.
6,522,746 B1 2/2003 Marchok et al.
6,683,960 B1 1/2004 Fujii et al.
6,766,292 B1 7/2004 Chandran
6,768,795 B2 7/2004 Feltstrom et al.
6,850,617 B1 2/2005 Weigand
6,940,982 B1 9/2005 Watkins
7,058,463 B1 6/2006 Ruha et al.
7,103,188 B1 9/2006 Jones
7,181,030 B2 2/2007 Rasmussen et al.
7,330,739 B2 2/2008 Somayajula
7,365,669 B1 4/2008 Melanson
7,680,456 B2 3/2010 Muhammad et al.
7,742,790 B2 6/2010 Konchitsky et al.
7,817,808 B2 * 10/2010 Konchitsky et al. ..... 381/94.7
8,019,050 B2 9/2011 Mactavish et al.
8,249,262 B2 8/2012 Chua et al.
8,290,537 B2 10/2012 Lee et al.
8,325,934 B2 12/2012 Kuo
8,379,884 B2 2/2013 Horibe et al.
8,401,200 B2 3/2013 Tiscareno et al.
8,442,251 B2 5/2013 Jensen et al.
8,737,636 B2 * 5/2014 Park et al. ..... 381/71.8
8,908,877 B2 12/2014 Abdollahzadeh Milani et al.
2001/0053228 A1 12/2001 Jones
2002/0003887 A1 1/2002 Zhang et al.
2003/0063759 A1 4/2003 Brennan et al.
2003/0185403 A1 * 10/2003 Sibbald ..... 381/71.6
2004/0047464 A1 3/2004 Yu et al.
2004/0165736 A1 8/2004 Hetherington et al.
2004/0167777 A1 8/2004 Hetherington et al.
2004/0202333 A1 10/2004 Csermak et al.
2004/0264706 A1 12/2004 Ray et al.
2005/0004796 A1 1/2005 Trump et al.
2005/0018862 A1 1/2005 Fisher
2005/0117754 A1 6/2005 Sakawaki
2005/0207585 A1 9/2005 Christoph
2005/0240401 A1 10/2005 Ebenezer
2006/0035593 A1 2/2006 Leeds
2006/0069556 A1 3/2006 Nadjar et al.
2006/0153400 A1 7/2006 Fujita et al.
2007/0030989 A1 2/2007 Kates
2007/0033029 A1 2/2007 Sakawaki
2007/0038441 A1 2/2007 Inoue et al.
2007/0053524 A1 3/2007 Haulick et al.
2007/0076896 A1 4/2007 Hosaka et al.
2007/0154031 A1 7/2007 Avendano et al.
2007/0258597 A1 11/2007 Rasmussen et al.
2007/0297620 A1 12/2007 Choy
2008/0019548 A1 1/2008 Avendano
2008/0107281 A1 5/2008 Togami et al.
2008/0144853 A1 6/2008 Sommerfeldt et al.
2008/0177532 A1 7/2008 Greiss et al.
2008/0181422 A1 7/2008 Christoph
2008/0226098 A1 9/2008 Haulick et al.
2008/0240455 A1 10/2008 Inoue et al.
2008/0240457 A1 10/2008 Inoue et al.
2009/0012783 A1 1/2009 Klein
2009/0034748 A1 2/2009 Sibbald
2009/0041260 A1 2/2009 Jorgensen et al.
2009/0046867 A1 2/2009 Clemow
2009/0060222 A1 3/2009 Jeong et al.
2009/0080670 A1 3/2009 Solbeck et al.
2009/0086990 A1 4/2009 Christoph
2009/0175466 A1 7/2009 Elko et al.
2009/0196429 A1 8/2009 Ramakrishnan et al.
2009/0220107 A1 9/2009 Every et al.
2009/0238369 A1 9/2009 Ramakrishnan et al.
2009/0245529 A1 10/2009 Asada et al.
2009/0254340 A1 10/2009 Sun et al.
2009/0290718 A1 11/2009 Kahn et al.
2009/0296965 A1 12/2009 Kojima
2009/0304200 A1 12/2009 Kim et al.
2009/0311979 A1 12/2009 Husted et al.
2010/0014683 A1 1/2010 Maeda et al.
2010/0014685 A1 1/2010 Wurm
2010/0061564 A1 3/2010 Clemow et al.
2010/0069114 A1 3/2010 Lee et al.
2010/0082339 A1 4/2010 Konchitsky et al.
2010/0098263 A1 4/2010 Pan et al.
2010/0098265 A1 4/2010 Pan et al.
2010/0124336 A1 5/2010 Shridhar et al.
2010/0124337 A1 5/2010 Wertz et al.
2010/0131269 A1 5/2010 Park et al.
2010/0150367 A1 6/2010 Mizuno
2010/0158330 A1 6/2010 Guissin et al.
2010/0166203 A1 7/2010 Peissig et al.
2010/0195838 A1 8/2010 Bright
2010/0195844 A1 8/2010 Christoph et al.
2010/0207317 A1 8/2010 Iwami et al.
2010/0246855 A1 9/2010 Chen
2010/0272276 A1 10/2010 Carreras et al.
2010/0272283 A1 10/2010 Carreras et al.
2010/0274564 A1 10/2010 Bakalos et al.
2010/0284546 A1 11/2010 Debrunner et al.
2010/0291891 A1 11/2010 Ridgers et al.
2010/0296666 A1 11/2010 Lin
2010/0296668 A1 11/2010 Lee et al.
2010/0310086 A1 12/2010 Magrath et al.
2010/0322430 A1 12/2010 Isberg
2011/0007907 A1 1/2011 Park et al.
2011/0026724 A1 * 2/2011 Doclo ..... 381/71.8
2011/0106533 A1 5/2011 Yu
2011/0129098 A1 6/2011 Delano et al.
2011/0130176 A1 6/2011 Magrath et al.
2011/0142247 A1 6/2011 Fellers et al.
2011/0144984 A1 6/2011 Konchitsky
2011/0158419 A1 6/2011 Theverapperuma et al.
2011/0206214 A1 8/2011 Christoph et al.
2011/0222698 A1 9/2011 Asao et al.
2011/0249826 A1 10/2011 Van Leest
2011/0288860 A1 11/2011 Schevciw et al.
2011/0293103 A1 12/2011 Park et al.
2011/0299695 A1 12/2011 Nicholson
2011/0305347 A1 12/2011 Wurm
2011/0317848 A1 12/2011 Ivanov et al.
2012/0135787 A1 5/2012 Kusunoki et al.
2012/0140917 A1 * 6/2012 Nicholson et al. ..... 381/71.6
2012/0140942 A1 6/2012 Loeda
2012/0140943 A1 6/2012 Hendrix et al.
2012/0148062 A1 6/2012 Scarlett et al.
2012/0155666 A1 6/2012 Nair
2012/0170766 A1 7/2012 Alves et al.
2012/0207317 A1 8/2012 Abdollahzadeh Milani et al.
2012/0215519 A1 8/2012 Park et al.
2012/0250873 A1 10/2012 Bakalos et al.
2012/0259626 A1 10/2012 Li et al.
2012/0263317 A1 10/2012 Shin et al.
2012/0300958 A1 11/2012 Klemmensen
2012/0300960 A1 11/2012 Mackay et al.
2012/0308021 A1 12/2012 Kwatra et al.
2012/0308024 A1 12/2012 Alderson et al.
2012/0308025 A1 12/2012 Hendrix et al.
2012/0308026 A1 12/2012 Kamath et al.
2012/0308027 A1 12/2012 Kwatra
2012/0308028 A1 12/2012 Kwatra et al.
2012/0310640 A1 12/2012 Kwatra et al.

(56) References Cited

U.S. PATENT DOCUMENTS

| | | | |
|---|---|---|---|
| 2013/0010982 | A1 | 1/2013 | Elko et al. |
| 2013/0083939 | A1 | 4/2013 | Fellers et al. |
| 2013/0243225 | A1 | 9/2013 | Yokota |
| 2013/0272539 | A1 | 10/2013 | Kim et al. |
| 2013/0287219 | A1 | 10/2013 | Hendrix et al. |
| 2013/0301842 | A1 | 11/2013 | Hendrix et al. |
| 2013/0301846 | A1 | 11/2013 | Alderson et al. |
| 2013/0301847 | A1 | 11/2013 | Alderson et al. |
| 2013/0301848 | A1 | 11/2013 | Zhou et al. |
| 2013/0301849 | A1 | 11/2013 | Alderson et al. |
| 2013/0343556 | A1 | 12/2013 | Bright |
| 2013/0343571 | A1 | 12/2013 | Rayala et al. |
| 2014/0044275 | A1 | 2/2014 | Goldstein et al. |
| 2014/0050332 | A1 | 2/2014 | Nielsen et al. |
| 2014/0086425 | A1 | 3/2014 | Jensen et al. |
| 2014/0177851 | A1 | 6/2014 | Kitazawa et al. |
| 2014/0211953 | A1 | 7/2014 | Alderson et al. |
| 2014/0270222 | A1 | 9/2014 | Hendrix et al. |
| 2014/0270223 | A1 | 9/2014 | Li et al. |
| 2014/0270224 | A1 | 9/2014 | Zhou et al. |
| 2015/0092953 | A1 | 4/2015 | Abdollahzadeh Milani et al. |

FOREIGN PATENT DOCUMENTS

| | | | |
|---|---|---|---|
| EP | 1947642 | A1 | 7/2008 |
| EP | 2133866 | A1 | 12/2009 |
| EP | 2216774 | A1 | 8/2010 |
| EP | 2395500 | A1 | 12/2011 |
| EP | 2395501 | A1 | 12/2011 |
| GB | 2401744 | A | 11/2004 |
| GB | 2455821 | A | 6/2009 |
| GB | 2455824 | A | 6/2009 |
| GB | 2455828 | A | 6/2009 |
| GB | 2484722 | A | 4/2012 |
| JP | H06-186985 | A | 7/1994 |
| WO | WO 03/015074 | A1 | 2/2003 |
| WO | WO 03015275 | A1 | 2/2003 |
| WO | WO 2004009007 | A1 | 1/2004 |
| WO | WO 2004017303 | A1 | 2/2004 |
| WO | WO 2007007916 | A1 | 1/2007 |
| WO | WO 2007113487 | A1 | 11/2007 |
| WO | WO 2010117714 | A1 | 10/2010 |
| WO | WO 2012134874 | A1 | 10/2012 |

OTHER PUBLICATIONS

U.S. Appl. No. 13/762,504, filed Feb. 8, 2013, Abdollahzadeh Milani, et al.
U.S. Appl. No. 13/721,832, filed Dec. 20, 2012, Lu, et al.
U.S. Appl. No. 13/724,656, filed Dec. 21, 2012, Lu, et al.
U.S. Appl. No. 14/252,235, filed Apr. 14, 2014, Lu, et al.
U.S. Appl. No. 13/968,013, filed Aug. 15, 2013, Abdollahzadeh Milani, et al.
U.S. Appl. No. 13/924,935, filed Jun. 24, 2013, Hellman.
U.S. Appl. No. 13/896,526, filed May 17, 2013, Naderi.
U.S. Appl. No. 14/101,955, filed Dec. 10, 2013, Alderson.
U.S. Appl. No. 14/101,777, filed Dec. 10, 2013, Alderson et al.
Abdollahzadeh Milani, et al., "On Maximum Achievable Noise Reduction in ANC Systems",2010 IEEE International Conference on Acoustics Speech and Signal Processing, Mar. 14-19, 2010, pp. 349-352, Dallas, TX, US.
Cohen, Israel, "Noise Spectrum Estimation in Adverse Environments: Improved Minima Controlled Recursive Averaging", IEEE Transactions on Speech and Audio Processing, Sep. 2003, pp. 1-11, vol. 11, Issue 5, Piscataway, NJ, US.
Ryan, et al., "Optimum Near-Field Performance of Microphone Arrays Subject to a Far-Field Beampattern Constraint", J. Acoust. Soc. Am., Nov. 2000, pp. 2248-2255, 108 (5), Pt. 1, Ottawa, Ontario, Canada.
Cohen, et al., "Noise Estimation by Minima Controlled Recursive Averaging for Robust Speech Enhancement", IEEE Signal Processing Letters, Jan. 2002, pp. 12-15, vol. 9, No. 1, Piscataway, NJ, US.
Martin, Rainer, "Noise Power Spectral Density Estimation Based on Optimal Smoothing and Minimum Statistics", IEEE Transactions on Speech and Audio Processing, Jul. 2001, pp. 504-512, vol. 9, No. 5, Piscataway, NJ, US.
Martin, Rainer, "Spectral Subtraction Based on Minimum Statistics", Signal Processing VII Theories and Applications, Proceedings of EUSIPCO-94, 7th European Signal Processing Conference, Sep. 13-16, 1994, pp. 1182-1185, vol. III, Edinburgh, Scotland, U.K.
Booij, et al., "Virtual sensors for local, three dimensional, broadband multiple-channel active noise control and the effects on the quiet zones", Proceedings of the International Conference on Noise and Vibration Engineering, ISMA 2010, Sep. 20-22, 2010, pp. 151-166, Leuven.
Kuo, et al., "Residual noise shaping technique for active noise control systems", J. Acoust. Soc. Am. 95 (3), Mar. 1994, pp. 1665-1668.
Lopez-Caudana, Edgar Omar, "Active Noise Cancellation: The Unwanted Signal and the Hybrid Solution", Adaptive Filtering Applications, Dr. Lino Garcia (Ed.), Jul. 2011, pp. 49-84, ISBN: 978-953-307-306-4, InTech.
Senderowicz, et al., "Low-Voltage Double-Sampled Delta-Sigma Converters", IEEE Journal on Solid-State Circuits, Dec. 1997, pp. 1907-1919, vol. 32, No. 12, Piscataway, NJ.
Hurst, et al., "An improved double sampling scheme for switched-capacitor delta-sigma modulators", 1992 IEEE Int. Symp. on Circuits and Systems, May 10-13, 1992, vol. 3, pp. 1179-1182, San Diego, CA.
U.S. Appl. No. 13/686,353, filed Nov. 27, 2012, Hendrix, et al.
U.S. Appl. No. 13/795,160, filed Mar. 12, 2013, Hendrix, et al.
U.S. Appl. No. 13/722,119, filed Dec. 20, 2012, Hendrix, et al.
U.S. Appl. No. 13/727,718, filed Dec. 27, 2012, Alderson, et al.
U.S. Appl. No. 13/784,018, filed Mar. 4, 2013, Alderson, et al.
U.S. Appl. No. 13/787,906, filed Mar. 7, 2013, Alderson, et al.
U.S. Appl. No. 13/729,141, filed Dec. 28, 2012, Zhou, et al.
U.S. Appl. No. 13/794,931, filed Mar. 12, 2013, Lu, et al.
U.S. Appl. No. 13/794,979, filed Mar. 12, 2013, Alderson, et al.
Pfann, et al., "LMS Adaptive Filtering with Delta-Sigma Modulated Input Signals," IEEE Signal Processing Letters, Apr. 1998, pp. 95-97, vol. 5, No. 4, IEEE Press, Piscataway, NJ.
Toochinda, et al. "A Single-Input Two-Output Feedback Formulation for ANC Problems," Proceedings of the 2001 American Control Conference, Jun. 2001, pp. 923-928, vol. 2, Arlington, VA.
Kuo, et al., "Active Noise Control: A Tutorial Review," Proceedings of the IEEE, Jun. 1999, pp. 943-973, vol. 87, No. 6, IEEE Press, Piscataway, NJ.
Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.
Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.
Mali, Dilip, "Comparison of DC Offset Effects on LMS Algorithm and its Derivatives," International Journal of Recent Trends in Engineering, May 2009, pp. 323-328, vol. 1, No. 1, Academy Publisher.
Kates, James M., "Principles of Digital Dynamic Range Compression," Trends in Amplification, Spring 2005, pp. 45-76, vol. 9, No. 2, Sage Publications.
Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.
Silva, et al., "Convex Combination of Adaptive Filters With Different Tracking Capabilities," IEEE International Conference on Acoustics, Speech, and Signal Processing, Apr. 15-20, 2007, pp. III 925-III 928, vol. 3, Honolulu, HI, USA.
Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.
Davari, et al., "A New Online Secondary Path Modeling Method for Feedforward Active Noise Control Systems," IEEE International Conference on Industrial Technology, Apr. 21-24, 2008, pp. 1-6, Chengdu, China.

(56) References Cited

OTHER PUBLICATIONS

Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.
Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.
Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.
Jin, et al. "A simultaneous equation method-based online secondary path modeling algorithm for active noise control", Journal of Sound and Vibration, Apr. 25, 2007, pp. 455-474, vol. 303, No. 3-5, London, GB.
Erkelens, et al., "Tracking of Nonstationary Noise Based on Data-Driven Recursive Noise Power Estimation", IEEE Transactions on Audio Speech and Language Processing, Aug. 2008, pp. 1112-1123, vol. 16, No. 6, Piscataway, NJ, US.
Rao, et al., "A Novel Two State Single Channel Speech Enhancement Technique", India Conference (INDICON) 2011 Annual IEEE, IEEE, Dec. 2011, 6 pages (pp. 1-6 in pdf), Piscataway, NJ, US.
Rangachari, et al., "A noise-estimation algorithm for highly non-stationary environments", Speech Communication, Feb. 2006, pp. 220-231, vol. 48, No. 2. Elsevier Science Publishers.
U.S. Appl. No. 13/968,007, filed Aug. 15, 2013, Hendrix, et al.
Parkins, et al., "Narrowband and broadband active control in an enclosure using the acoustic energy density", J. Acoust. Soc. Am. Jul. 2000, pp. 192-203, vol. 108, issue 1, US.
Feng, et al.., "A broadband self-tuning active noise equaliser", Signal Processing, Oct. 1, 1997, pp. 251-256, vol. 62, No. 2, Elsevier Science Publishers B.V. Amsterdam, NL.
Zhang, et al., "A Robust Online Secondary Path Modeling Method with Auxiliary Noise Power Scheduling Strategy and Norm Constraint Manipulation", IEEE Transactions on Speech and Audio Processing, IEEE Service Center, Jan. 1, 2003, pp. 45-53, vol. 11, No. 1, NY.
Lopez-Gaudana, et al., "A hybrid active noise cancelling with secondary path modeling", 51st Midwest Symposium on Circuits and Systems, MWSCAS 2008, Aug. 10-13, 2008, pp. 277-280, IEEE, Knoxville, TN.
U.S. Appl. No. 14/197,814, filed Mar. 5, 2014, Kaller, et al.
U.S. Appl. No. 14/210,537, filed Mar. 14, 2014, Abdollahzadeh Milani, et al.
U.S. Appl. No. 14/210,589, filed Mar. 14, 2014, Abdollahzadeh Milani, et al.
Black, John W., "An Application of Side-Tone in Subjective Tests of Microphones and Headsets", Project Report No. NM 001 064.01.20, Research Report of the U.S. Naval School of Aviation Medicine, Feb. 1, 1954, 12 pages (pp. 1-12 in pdf), Pensacola, FL, US.
Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.
Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.
Liu, et al., "Compensatory Responses to Loudness-shifted Voice Feedback During Production of Mandarin Speech", Journal of the Acoustical Society of America, Oct. 2007, pp. 2405-2412, vol. 122, No. 4.
Paepcke, et al., "Yelling in the Hall: Using Sidetone to Address a Problem with Mobile Remote Presence Systems", Symposium on User Interface Software and Technology, Oct. 16-19, 2011, 10 pages (pp. 1-10 in pdf), Santa Barbara, CA, US.
Therrien, et al., "Sensory Attenuation of Self-Produced Feedback: The Lombard Effect Revisited", PLOS One, Nov. 2012, pp. 1-7, vol. 7, Issue 11, e49370, Ontario, Canada.
U.S. Appl. No. 14/029,159, filed Sep. 17, 2013, Li, et al.
U.S. Appl. No. 14/062,951, filed Oct. 25, 2013, Zhou, et al.
U.S. Appl. No. 14/578,567, filed Dec. 22, 2014, Kwatra, et al.
Widrow, B., et al., Adaptive Noise Cancelling; Principles and Applications, Proceedings of the IEEE, Dec. 1975, pp. 1692-1716, vol. 63, No. 13, IEEE, New York, NY, US.
Morgan, et al., A Delayless Subband Adaptive Filter Architecture, IEEE Transactions on Signal Processing, IEEE Service Center, Aug. 1995, pp. 1819-1829, vol. 43, No. 8, New York, NY, US.

* cited by examiner

LEAKAGE-MODELING ADAPTIVE NOISE CANCELING FOR EARSPEAKERS

This U.S. Patent Application claims priority under 35 U.S.C. 119(e) to U.S. Provisional Patent Application Ser. No. 61/638,602 filed on Apr. 26, 2012.

BACKGROUND OF THE INVENTION

1. Field of the Invention

The present invention relates generally to personal audio devices such as headphones that include adaptive noise cancellation (ANC), and, more specifically, to architectural features of an ANC system in which leakage from an earspeaker to the reference microphone is modeled.

2. Background of the Invention

Wireless telephones, such as mobile/cellular telephones, cordless telephones, and other consumer audio devices, such as MP3 players, are in widespread use. Performance of such devices with respect to intelligibility can be improved by providing noise canceling using a reference microphone to measure ambient acoustic events and then using signal processing to insert an anti-noise signal into the output of the device to cancel the ambient acoustic events.

When the acoustic path from the transducer to the reference microphone is not highly attenuative, for example when the transducer and reference microphone are included on an earspeaker, or when a telephone-mounted output transducer is not pressed to the user's ear, the ANC system will try to cancel the portion of the playback signal that arrives at the reference microphone.

Therefore, it would be desirable to provide a personal audio device, including a wireless telephone that provides noise cancellation that is effective and/or does not generate undesirable responses when leakage is present from the output transducer to the reference microphone.

SUMMARY OF THE INVENTION

The above stated objectives of providing a personal audio device having effective noise cancellation when leakage is present, is accomplished in a personal audio system, a method of operation, and an integrated circuit.

The personal audio device includes an output transducer for reproducing an audio signal that includes both source audio for playback to a listener, and an anti-noise signal for countering the effects of ambient audio sounds in an acoustic output of the transducer. The personal audio device also includes the integrated circuit to provide adaptive noise-canceling (ANC) functionality. The method is a method of operation of the personal audio system and integrated circuit. A reference microphone is mounted on the device housing to provide a reference microphone signal indicative of the ambient audio sounds. The personal audio system further includes an ANC processing circuit for adaptively generating an anti-noise signal from the reference microphone signal, such that the anti-noise signal causes substantial cancellation of the ambient audio sounds. An adaptive filter can be used to generate the anti-noise signal by filtering the reference microphone signal. The ANC processing circuit further models an acoustic leakage path from the acoustic output of the output transducer to the reference microphone, and removes elements of the acoustic output appearing at the reference microphone signal. The leakage path modeling may be performed by another adaptive filter.

The foregoing and other objectives, features, and advantages of the invention will be apparent from the following, more particular, description of the preferred embodiment of the invention, as illustrated in the accompanying drawings.

DESCRIPTION OF ILLUSTRATIVE EMBODIMENT

The present invention encompasses noise canceling techniques and circuits that can be implemented in a personal audio system, such as a wireless telephone and connected earbuds. The personal audio system includes an adaptive noise canceling (ANC) circuit that measures the ambient acoustic environment at the earbuds or other output transducer and generates a signal that is injected in the speaker (or other transducer) output to cancel ambient acoustic events. A reference microphone is provided to measure the ambient acoustic environment, which is used to generate an anti-noise signal provided to the speaker to cancel the ambient audio sounds. A model of a leakage path from the speaker output to the reference microphone input is also implemented by the ANC circuit so that the source audio and /or the anti-noise signal reproduced by the transducer can be removed from the reference microphone signal. The leakage path audio is implemented so that the ANC circuit does not try to adapt to and cancel the source audio and anti-noise signal, or otherwise become disrupted by leakage.

Figure 1A:
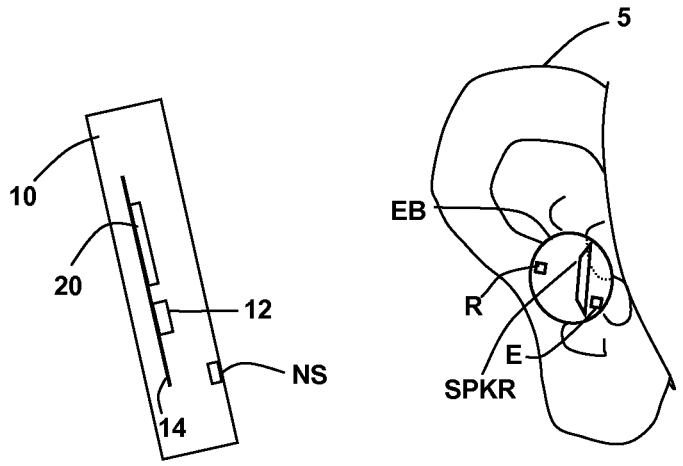
FIG. 1A is an illustration of a wireless telephone 10 coupled to an earbud EB, which is an example of a personal audio device in which the techniques disclosed herein can be implemented.

FIG. 1A shows a wireless telephone 10 proximity to a human ear 5. Illustrated wireless telephone 10 is an example of a device in which the techniques herein may be employed, but it is understood that not all of the elements or configurations illustrated in wireless telephone 10, or in the circuits depicted in subsequent illustrations, are required. Wireless telephone 10 is connected to an earbud EB by a wired or wireless connection, e.g., a BLUETOOTH™ connection (BLUETOOTH is a trademark or Bluetooth SIG, Inc.). Earbud EB has a transducer, such as speaker SPKR, which reproduces source audio including distant speech received from wireless telephone 10, ringtones, stored audio program material, and injection of near-end speech (i.e., the speech of the user of wireless telephone 10). The source audio also includes any other audio that wireless telephone 10 is required to reproduce, such as source audio from web-pages or other network communications received by wireless telephone 10 and audio indications such as battery low and other system event notifications. A reference microphone R is provided on a surface of a housing of earbud EB for measuring the ambient acoustic environment. Another microphone, error microphone E, is provided in order to further improve the ANC operation by providing a measure of the ambient audio combined with the audio reproduced by speaker SPKR close to ear 5, when earbud EB is inserted in the outer portion of ear 5. While the illustrated example shows an earspeaker implementation of a leakage path modeling noise canceling system, the techniques disclosed herein can also be implemented in a wireless telephone or other personal audio device, in which the output transducer and reference/error microphones are all provided on a housing of the wireless telephone or other personal audio device.

Wireless telephone 10 includes adaptive noise canceling (ANC) circuits and features that inject an anti-noise signal into speaker SPKR to improve intelligibility of the distant speech and other audio reproduced by speaker SPKR. Exemplary circuit 14 within wireless telephone 10 includes an audio CODEC integrated circuit 20 that receives the signals from reference microphone R, near speech microphone NS, and error microphone E and interfaces with other integrated circuits such as an RF integrated circuit 12 containing the wireless telephone transceiver. In other embodiments of the invention, the circuits and techniques disclosed herein may be incorporated in a single integrated circuit that contains control circuits and other functionality for implementing the entirety of the personal audio device, such as an MP3 player-on-a-chip integrated circuit. Alternatively, the ANC circuits may be included within a housing of earbud EB or in a module located along a wired connection between wireless telephone 10 and earbud EB. For the purposes of illustration, the ANC circuits will be described as provided within wireless telephone 10, but the above variations are understandable by a person of ordinary skill in the art and the consequent signals that are required between earbud EB, wireless telephone 10 and a third module, if required, can be easily determined for those variations. A near-speech microphone NS is provided at a housing of wireless telephone 10 to capture near-end speech, which is transmitted from wireless telephone 10 to the other conversation participant(s). Alternatively, near-speech microphone NS may be provided on the outer surface of a housing of earbud EB, or on a boom affixed to earbud EB.

Figure 1B:
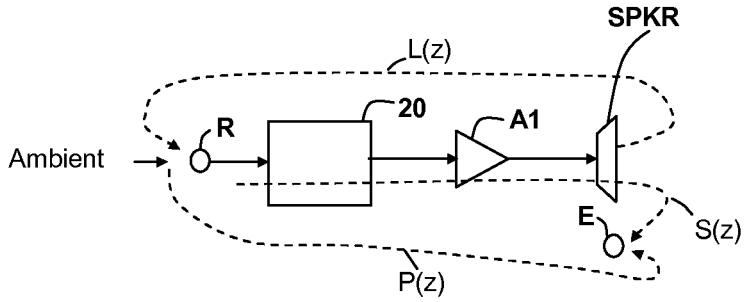
FIG. 1B is an illustration of electrical and acoustical signal paths in FIG. 1A.

FIG. 1B shows a simplified schematic diagram of an audio CODEC integrated circuit 20 that includes ANC processing, as coupled to reference microphone R, which provides a measurement of ambient audio sounds Ambient that is filtered by the ANC processing circuits within audio CODEC integrated circuit 20. Audio CODEC integrated circuit 20 generates an output that is amplified by an amplifier Al and is provided to speaker SPKR. Audio CODEC integrated circuit 20 receives the signals (wired or wireless depending on the particular configuration) from reference microphone R, near speech microphone NS and error microphone E and interfaces with other integrated circuits such as an RF integrated circuit 12 containing the wireless telephone transceiver. In other configurations, the circuits and techniques disclosed herein may be incorporated in a single integrated circuit that contains control circuits and other functionality for implementing the entirety of the personal audio device, such as an MP3 player-on-a-chip integrated circuit. Alternatively, multiple integrated circuits may be used, for example, when a wireless connection is provided from earbud EB to wireless telephone 10 and/or when some or all of the ANC processing is performed within earbud EB or a module disposed along a cable connecting wireless telephone 10 to earbud EB.

In general, the ANC techniques illustrated herein measure ambient acoustic events (as opposed to the output of speaker SPKR and/or the near-end speech) impinging on reference microphone R, and also measure the same ambient acoustic events impinging on error microphone E. The ANC processing circuits of illustrated wireless telephone 10 adapt an anti-noise signal generated from the output of reference microphone R to have a characteristic that minimizes the amplitude of the ambient acoustic events at error microphone E. Since acoustic path P(z) extends from reference microphone R to error microphone E, the ANC circuits are essentially estimating acoustic path P(z) combined with removing effects of an electro-acoustic path S(z) that represents the response of the audio output circuits of CODEC IC 20 and the acoustic/electric transfer function of speaker SPKR. The estimated response includes the coupling between speaker SPKR and error microphone E in the particular acoustic environment which is affected by the proximity and structure of ear 5 and other physical objects and human head structures that may be in proximity to earbud EB. Leakage, i.e., acoustic coupling, between speaker SPKR and reference microphone R can cause error in the anti-noise signal generated by the ANC circuits within CODEC IC 20. In particular, desired downlink speech and other internal audio intended for reproduction by speaker SPKR can be partially canceled due to the leakage path L(z) between speaker SPKR and reference microphone R. Since audio measured by reference microphone R is considered to be ambient audio that generally should be canceled, leakage path L(z) represents the portion of the downlink speech and other internal audio that is present in the reference microphone signal and causes the above-described erroneous operation. Therefore, the ANC circuits within CODEC IC 20 include leakage-path modeling circuits that compensate for the presence of leakage path L(z). While the illustrated wireless telephone 10 includes a two microphone ANC system with a third near speech microphone NS, a system may be constructed that does not include separate error and reference microphones. Alternatively, when near speech microphone NS is located proximate to speaker SPKR and error microphone E, near-speech microphone NS may be used to perform the function of the reference microphone R. Also, in personal audio devices designed only for audio playback, near speech microphone NS will generally not be included, and the near-speech signal paths in the circuits described in further detail below can be omitted.

Figure 2:
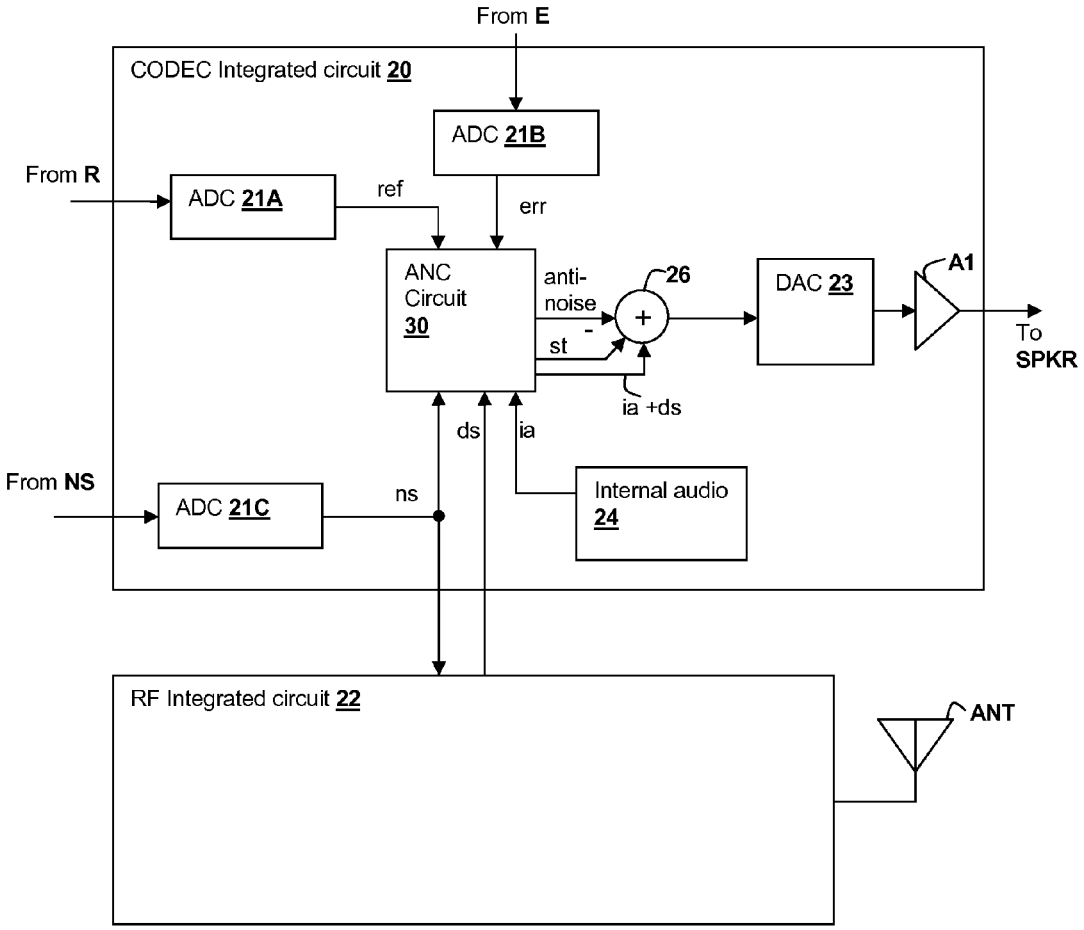
FIG. 2 is a block diagram of circuits within wireless telephone 10 and/or earbud EB of FIG. 1A.

Referring now to FIG. 2, circuits within wireless telephone 10 are shown in a block diagram. The circuit shown in FIG. 2 further applies to the other configurations mentioned above, except that signaling between CODEC integrated circuit 20 and other units within wireless telephone 10 are provided by cables or wireless connections when CODEC integrated circuit 20 is located outside of wireless telephone 10. In such a configuration, signaling between CODEC integrated circuit 20 and error microphone E, reference microphone R and speaker SPKR are provided by wired or wireless connections when CODEC integrated circuit 20 is located within wireless telephone 10. CODEC integrated circuit 20 includes an analog-to-digital converter (ADC) 21A for receiving the reference microphone signal and generating a digital representation ref of the reference microphone signal. CODEC integrated circuit 20 also includes an ADC 21B for receiving the error microphone signal and generating a digital representation err of the error microphone signal, and an ADC 21C for receiving the near speech microphone signal and generating a digital representation ns of the error microphone signal. CODEC IC 20 generates an output for driving speaker SPKR from an amplifier A1, which amplifies the output of a digital-to-analog converter (DAC) 23 that receives the output of a combiner 26. Combiner 26 combines audio signals is from internal audio sources 24, and the anti-noise signal anti-noise generated by ANC circuit 30, which by convention has the same polarity as the noise in reference microphone signal ref and is therefore subtracted by combiner 26. Combiner 26 also combines an attenuated portion of near speech signal ns, i.e., sidetone information st, so that the user of wireless telephone 10 hears their own voice in proper relation to downlink speech ds, which is received from radio frequency (RF) integrated circuit 22. Near speech signal ns is also provided to RF integrated circuit 22 and is transmitted as uplink speech to the service provider via antenna ANT.

Figure 3:
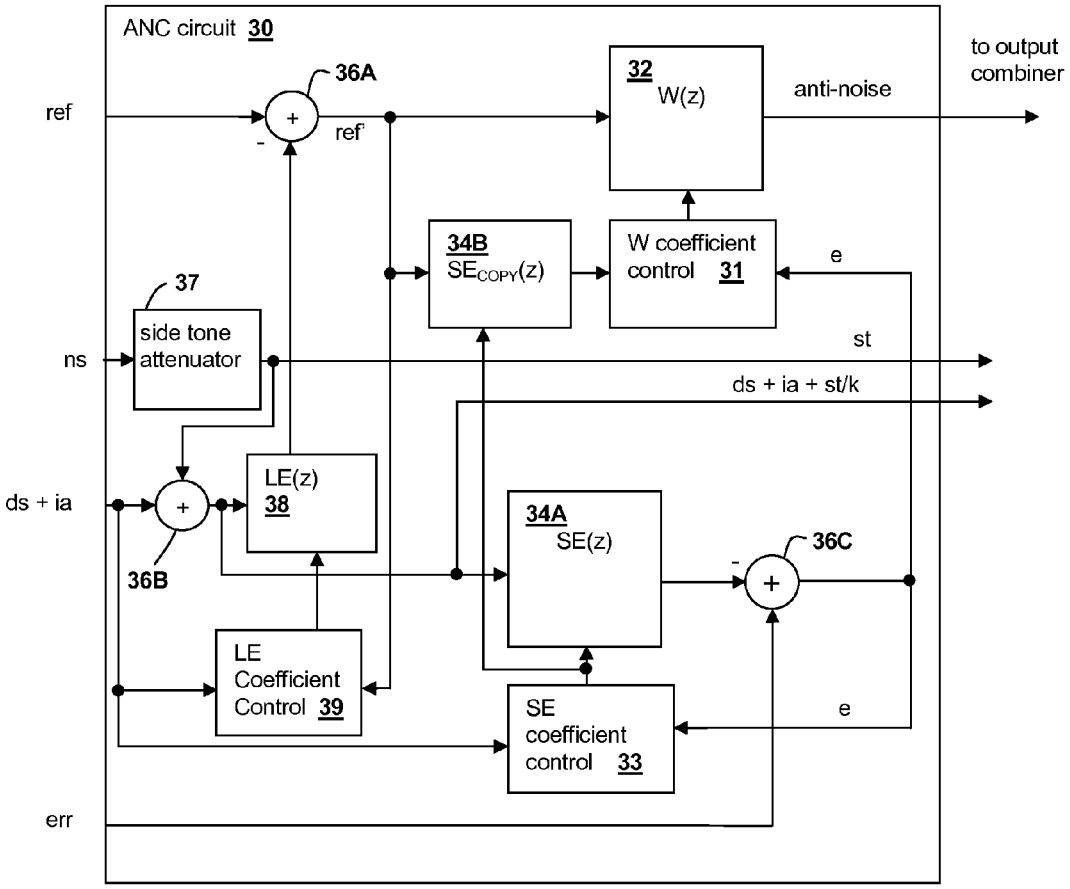
FIG. 3 is a block diagram depicting signal processing circuits and functional blocks within ANC circuit 30 of CODEC integrated circuit 20 of FIG. 2 in accordance with an embodiment of the present invention.

Referring now to FIG. 3, details of ANC circuit 30 are shown. A combiner 36A removes an estimated leakage signal, which in the example is provided by a leakage-path adaptive filter 38 that models leakage path L(z), but which may be provided by a fixed filter in other configurations. Combiner 36A generates a leakage-corrected reference microphone signal ref. An adaptive filter 32 receives leakage-corrected reference microphone signal ref' and under ideal circumstances, adapts its transfer function W(z) to be P(z)/S(z) to generate the anti-noise signal anti-noise, which is provided to an output combiner that combines the anti-noise signal with the audio to be reproduced by speaker SPKR, as exemplified by combiner 26 of FIG. 2. The coefficients of adaptive filter 32 are controlled by a W coefficient control block 31 that uses a correlation of two signals to determine the response of adaptive filter 32, which generally minimizes the error, in a least-mean squares sense, between those components of leakage-corrected reference microphone signal ref' present in error microphone signal err. The signals processed by W coefficient control block 31 are the leakage-corrected reference microphone signal ref' shaped by a copy of an estimate of the response of path S(z) (i.e., response $SE_{COPY}(z)$) provided by filter 34B and another signal that includes error microphone signal err. By transforming leakage-corrected reference microphone signal ref with a copy of the estimate of the response of path S(z), response $SE_{COPY}(z)$, and minimizing error microphone signal err after removing components of error microphone signal err due to playback of source audio, adaptive filter 32 adapts to the desired response of P(z)/S(z).

In addition to error microphone signal err, the other signal processed along with the output of filter 34B by W coefficient control block 31 includes an inverted amount of the source audio including downlink audio signal ds, internal audio ia, and a portion of near speech signal ns attenuated by a side tone attenuator 37, which is provided from a combiner 36B. The output of combiner 36B is processed by a filter 34A having response SE(z), of which response $SE_{COPY}(z)$ is a copy. By injecting an inverted amount of source audio and sidetone that has been filtered by response SE(z), adaptive filter 32 is prevented from adapting to the relatively large amount of source audio and the sidetone information (along with extra ambient noise information in the sidetone) present in error microphone signal err. By transforming the inverted copy of downlink audio signal ds and internal audio ia with the estimate of the response of path S(z), the source audio and sidetone that is removed from error microphone signal err before processing should match the expected version of downlink audio signal ds and internal audio ia reproduced at error microphone signal err. The source audio and sidetone amounts match because the electrical and acoustical path of S(z) is the path taken by downlink audio signal ds, internal audio ia and sidetone information to arrive at error microphone E. Filter 34B is not an adaptive filter, per se, but has an adjustable response that is tuned to match the response of adaptive filter 34A, so that the response of filter 34B tracks the adapting of adaptive filter 34A.

To implement the above, adaptive filter 34A has coefficients controlled by SE coefficient control block 33. Adaptive filter 34A processes the source audio (ds+ia) and sidetone information, to provide a signal representing the expected source audio delivered to error microphone E. Adaptive filter 34A is thereby adapted to generate a signal from downlink audio signal ds, internal audio is and sidetone information st, that when subtracted from error microphone signal err, forms an error signal e containing the content of error microphone signal err that is not due to source audio (ds+ia) and the sidetone information st. A combiner 36C removes the filtered source audio (ds+ia) and sidetone information from error microphone signal err to generate the above-described error signal e. Similarly, leakage path adaptive filter 38 processes the source audio (ds+ia) and sidetone information, to provide a signal representing the source audio delivered to reference microphone R through leakage path L(z). Leakage path adaptive filter 38 has coefficients controlled by LE coefficient control block 39 that also receives source audio (ds+ia) and the sidetone information and controls leakage path adaptive filter 38 to pass those components of source audio (ds+ia) and the sidetone information appearing in leakage-corrected reference microphone signal ref, so that those components are minimized at the input to adaptive filter 32. Alternatively, the sidetone information may be omitted from the signal introduced into leakage path adaptive filter 38. In a calibration mode, the error microphone signal and the reference microphone signal are exchanged. In the calibration mode, the processing circuit models the acoustic leakage path by removing the source audio from the reference microphone signal to provide the error signal, and the processing circuit generates the anti-noise signal from the error microphone signal. During calibration, coefficients of the secondary path adaptive filter are captured to provide coefficients of the leakage path adaptive filter that are subsequently applied in the normal operating mode.

Figure 4:
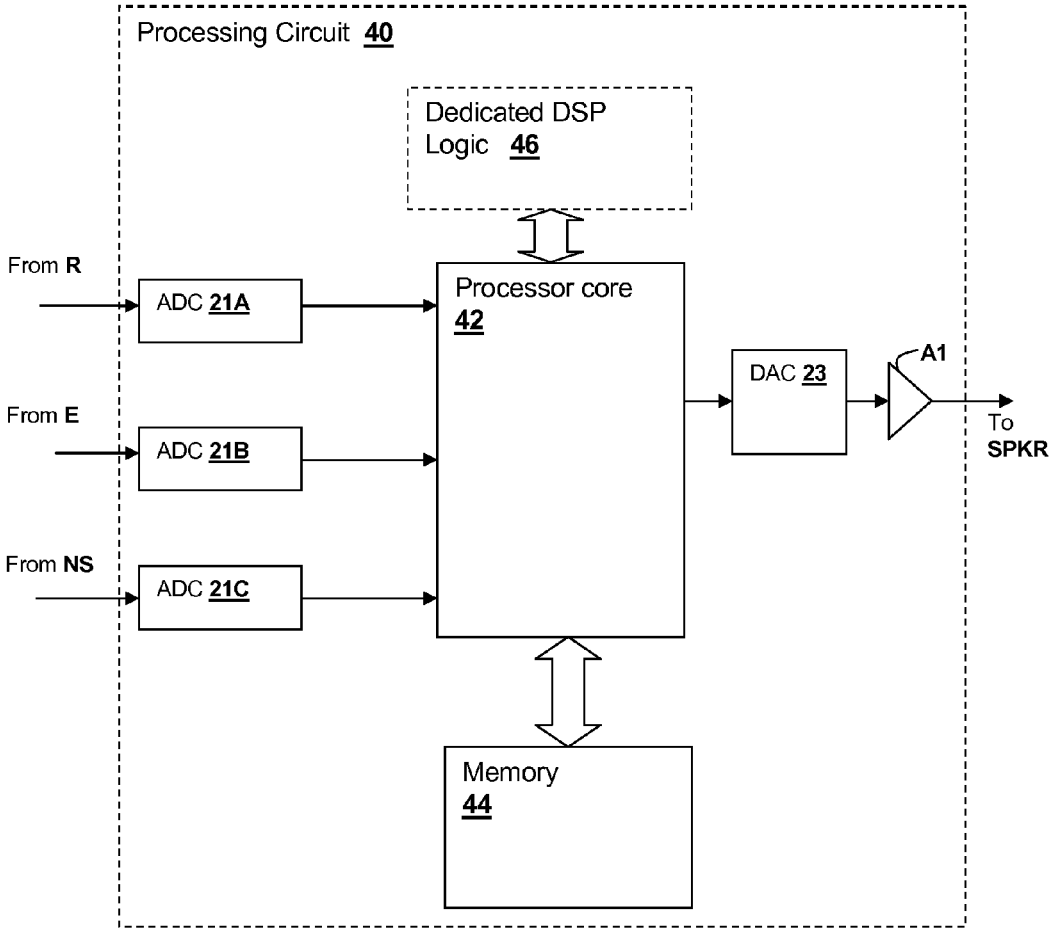
FIG. 4 is a block diagram depicting signal processing circuits and functional blocks within an integrated circuit in accordance with an embodiment of the present invention.

Referring now to FIG. 4, a block diagram of an ANC system is shown for implementing ANC techniques as depicted in FIG. 3, and having a processing circuit 40 as may be implemented within CODEC integrated circuit 20 of FIG. 2. Processing circuit 40 includes a processor core 42 coupled to a memory 44 in which are stored program instructions comprising a computer-program product that may implement some or all of the above-described ANC techniques, as well as other signal processing. Optionally, a dedicated digital signal processing (DSP) logic 46 may be provided to implement a portion of, or alternatively all of, the ANC signal processing provided by processing circuit 40. Processing circuit 40 also includes ADCs 21A-21C, for receiving inputs from reference microphone R, error microphone E and near speech microphone NS, respectively. In alternative embodiments in which one or more of reference microphone R, error microphone E and near speech microphone NS have digital outputs, the corresponding ones of ADCs 21A-21C are omitted and the digital microphone signal(s) are interfaced directly to processing circuit 40. DAC 23 and amplifier Al are also provided by processing circuit 40 for providing the speaker output signal, including anti-noise as described above. The speaker output signal may be a digital output signal for provision to a module that reproduces the digital output signal acoustically.

While the invention has been particularly shown and described with reference to the preferred embodiments thereof, it will be understood by those skilled in the art that the foregoing and other changes in form, and details may be made therein without departing from the spirit and scope of the invention.

What is claimed is:

1. An integrated circuit for implementing at least a portion of a personal audio device, comprising:

an output for providing an output signal to an output transducer including an anti-noise signal for countering the effects of ambient audio sounds in an acoustic output of the output transducer and source audio for playback to a listener;

a reference microphone input for receiving a reference microphone signal indicative of the ambient audio sounds;

an error microphone input for receiving an error microphone signal indicative of the acoustic output of the output transducer and the ambient audio sounds at the output transducer; and a processing circuit that adaptively generates the anti-noise signal from a corrected reference microphone signal and in conformity with the error microphone signal such that the anti-noise signal causes substantial cancellation of the ambient audio sounds, wherein the processing circuit combines the anti-noise signal with a source audio signal to generate the output signal, wherein the processing circuit further models an acoustic leakage path from the output transducer to the reference microphone with an adaptive filter that filters the source audio signal to generate filtered source audio and removes the filtered source audio from the reference microphone signal to generate the corrected reference microphone signal.

2. The integrated circuit of claim 1, wherein the processing circuit models the acoustic leakage path by providing source audio of a predetermined characteristic as the audio signal reproduced by the output transducer and measuring a resulting response in the reference microphone signal.

3. The personal audio device of claim 2, wherein the source audio of predetermined characteristic is a noise burst.

4. The integrated circuit of claim 1, wherein the processing circuit comprises an adaptive filter having a response that shapes the anti-noise signal to reduce the presence of the ambient audio sounds heard by the listener and another leakage path adaptive filter that models the acoustic leakage path dynamically.

5. The integrated circuit of claim 4, wherein the processing circuit comprises a secondary path adaptive filter having a secondary path response that shapes the source audio and a combiner that, in a normal operating mode, removes the source audio from the error microphone signal to provide the error signal, wherein the processing circuit generates the anti-noise signal in conformity with the error signal, wherein, in a calibration mode, the processing circuit models the acoustic leakage path by removing the source audio from the reference microphone signal to provide the error signal, wherein also in the calibration mode, the processing circuit generates the anti-noise signal from the error microphone signal, and wherein coefficients of the secondary path adaptive filter are captured during the calibration mode to provide coefficients of the leakage path adaptive filter that are subsequently applied in the normal operating mode.

6. The integrated circuit of claim 4, wherein adaptation of the leakage path adaptive filter is performed continuously except when a ratio of an amplitude of the source audio to an amplitude of the ambient audio sounds is less than a predetermined threshold.

7. The integrated circuit of claim 4, wherein the processing circuit determines that modeling of the acoustic leakage path is ineffective and, responsive to determining that the modeling of the acoustic leakage path is ineffective and determining that an amplitude of the source audio is greater than a threshold, halts adaptation of the adaptive filter that generates the anti-noise signal.

8. The integrated circuit of claim 4, wherein the processing circuit provides the source audio to a filter input of the leakage path adaptive filter.

9. The integrated circuit of claim 4, wherein the source audio includes sidetone information generated from a near speech microphone.

10. The integrated circuit of claim 9, wherein the processing circuit provides the sidetone information combined with the source audio to a filter input of the leakage path adaptive filter.

11. A method of countering effects of ambient audio sounds by a personal audio device, the method comprising:

first measuring ambient audio sounds with a reference microphone to produce a reference microphone signal;

second measuring an output of the transducer and the ambient audio sounds at the transducer with an error microphone;

adaptively generating an anti-noise signal from a corrected reference microphone signal in conformity with a result of the second measuring for countering the effects of ambient audio sounds in an acoustic output of a transducer;

providing the anti-noise signal to the transducer;

combining the anti-noise signal with a source audio signal to generate the output signal;

modeling an acoustic leakage path from the output transducer to the reference microphone with an adaptive filter that filters the source audio signal to generate filtered source audio; and removing the filtered source audio from the reference microphone signal to generate the corrected reference microphone signal.

12. The method of claim 11, wherein the modeling of the acoustic leakage path comprises:

providing source audio of predetermined characteristic as a portion of an audio signal reproduced by the output transducer; and measuring a resulting response to the providing in the reference microphone signal.

13. The method of claim 12, wherein the source audio of predetermined characteristic is a noise burst.

14. The method of claim 11, further comprising:

shaping the anti-noise with an adaptive filter to reduce the presence of the ambient audio sounds heard by the listener; and modeling the acoustic leakage path dynamically with a leakage path adaptive filter.

15. The method of claim 14, further comprising:

in a normal operating mode, removing the source audio from the error microphone signal to generate the error signal and modeling the acoustic leakage path by removing the source audio from the reference microphone signal to provide an error signal, wherein the adaptively generating generates the anti-noise signal in conformity with the error signal;

in a calibration mode, removing the source audio from the reference microphone signal, generating the anti-noise signal from the error microphone signal, and capturing coefficients of the secondary path adaptive filter to provide coefficients of the leakage path adaptive filter; and in the normal operating mode, subsequently applying the captured coefficients in the modeling of the acoustic leakage path by the leakage path adaptive filter.

16. The method of claim 14, wherein the modeling of the acoustic leakage path adapts the leakage path adaptive filter continuously except when a ratio of an amplitude of the source audio to an amplitude of the ambient audio sounds is less than a predetermined threshold.

17. The method of claim 14, wherein the determining comprises modeling of the acoustic leakage path is ineffective and, responsive to the determining that the modeling of the acoustic leakage path is ineffective and determining that an amplitude of the source audio is greater than a threshold, halting adaptation of the adaptive filter that generates the anti-noise signal.

18. The method of claim 14, further comprising providing the source audio to a filter input of the leakage path adaptive filter.

19. The method of claim 14, wherein the source audio includes sidetone information generated from a near speech microphone.

20. The method of claim 19, further comprising providing the sidetone information combined with the source audio to a filter input of the leakage path adaptive filter.

21. A personal audio device, comprising:

a personal audio device housing;

a transducer mounted on the housing for reproducing an audio signal including an anti-noise signal for countering effects of ambient audio sounds in an acoustic output of the output transducer and source audio for playback to a listener;

a reference microphone mounted on the housing for providing a reference microphone signal indicative of the ambient audio sounds;

an error microphone mounted on the housing in proximity to the transducer for providing an error microphone signal indicative of the acoustic output of the transducer and the ambient audio sounds at the transducer; and a processing circuit within the housing that adaptively generates the anti-noise signal from a corrected reference microphone signal and in conformity with the error microphone signal such that the anti-noise signal causes substantial cancellation of the ambient audio sounds, wherein the processing circuit combines the anti-noise signal with a source audio signal to generate the output signal, wherein the processing circuit further models an acoustic leakage path from the output transducer to the reference microphone with an adaptive filter that filters the source audio signal to generate filtered source audio and removes the filtered source audio from the reference microphone signal to generate the corrected reference microphone signal.

22. The personal audio device of claim 21, wherein the processing circuit models the acoustic leakage path by providing source audio of a predetermined characteristic as the audio signal reproduced by the output transducer and measuring a resulting response in the reference microphone signal.

23. The personal audio device of claim 22, wherein the source audio of predetermined characteristic is a noise burst.

24. The personal audio device of claim 22, wherein the processing circuit comprises an adaptive filter having a response that shapes the anti-noise signal to reduce the presence of the ambient audio sounds heard by the listener and another leakage path adaptive filter that models the acoustic leakage path dynamically.

25. The personal audio device of claim 24, wherein the processing circuit comprises a secondary path adaptive filter having a secondary path response that shapes the source audio and a combiner that, in a normal operating mode, removes the source audio from the error microphone signal to provide the error signal, wherein, in a calibration mode, the processing circuit models the acoustic leakage path by removing the source audio from the reference microphone signal to provide the error signal, wherein also in the calibration mode, the processing circuit generates the anti-noise signal from the error microphone signal, wherein the processing circuit generates the anti-noise signal in conformity with the error signal, and wherein coefficients of the secondary path adaptive filter are captured during the calibration mode to provide coefficients of the leakage path adaptive filter that are subsequently applied in the normal operating mode.

26. The personal audio device of claim 24, wherein adaptation of the leakage path is performed continuously except when a ratio of an amplitude of the source audio to an amplitude of the ambient audio sounds is less than a predetermined threshold.

27. The personal audio device of claim 24, wherein the processing circuit determines that modeling of the acoustic leakage path is ineffective and, responsive to determining that the modeling of the acoustic leakage path is ineffective and determining that an amplitude of the source audio is greater than a threshold, halts adaptation of the adaptive filter that generates the anti-noise signal.

28. The personal audio device of claim 24, wherein the processing circuit provides the source audio to a filter input of the leakage path adaptive filter.

29. The personal audio device of claim 24, wherein the source audio includes sidetone information generated from a near speech microphone mounted on the housing.

30. The personal audio device of claim 29, wherein the processing circuit provides the sidetone information combined with the source audio to a filter input of the leakage path adaptive filter.

* * * * *